US009855597B2

(12) United States Patent
Schaefer et al.

(10) Patent No.: US 9,855,597 B2
(45) Date of Patent: Jan. 2, 2018

(54) BREAKER CORE WITH NETLIKE WEBBING SPANNING ITS THROUGH-OPENING

(71) Applicant: GTP SCHAEFER GIESSTECHNISCHE PRODUKTE GmbH, Grevenbroich (DE)

(72) Inventors: Joerg Schaefer, Cologne (DE); Thomas Schaefer, Frechen (DE)

(73) Assignee: GTP SCHAEFER GIESSTECHNISCHE PRODUKTE GMBH, Grevenbroich (DE)

( * ) Notice: Subject to any disclaimer, the term of this patent is extended or adjusted under 35 U.S.C. 154(b) by 0 days.

(21) Appl. No.: 15/249,098

(22) Filed: Aug. 26, 2016

(65) Prior Publication Data

US 2017/0056965 A1 Mar. 2, 2017

(30) Foreign Application Priority Data

Aug. 27, 2015 (DE) ..... 20 2015 104 553 U

(51) Int. Cl.
*B22C 9/08* (2006.01)

(52) U.S. Cl.
CPC ..... *B22C 9/088* (2013.01); *B22C 9/084* (2013.01)

(58) Field of Classification Search
CPC ..... B22C 9/08; B22C 9/084; B22C 9/088
See application file for complete search history.

(56) References Cited

PUBLICATIONS

Hitchings et al. "Use Fabric, Breaker Cores to Cut Ductile Iron Finishing Cost". Reprinted from Feb. 1999 Modern Casting. http://www.comanchetechnologies.com/Documents/De-Gating%20Tech%20Paper%20to%20Revisit.pdf.*

* cited by examiner

*Primary Examiner* — Kevin P Kerns
*Assistant Examiner* — Steven Ha
(74) *Attorney, Agent, or Firm* — Johnson, Marcou & Isaacs, LLC; Jennifer S. Stachniak

(57) ABSTRACT

A breaker core for use in a casting process includes a disk-shaped breaker core (10) having breaker core body and a through-opening (11) for liquid metal. A ring-shaped frame (12) made from a heat-resistant material is secured to the breaker core (10) and has a netlike webbing (15) tensioned therein. The netlike webbing (15) is made from a fire-proof material and spans the through-opening (11) of the breaker core (10) on an underside of a feeder. The frame (17) is secured with an outer sidewall (17) to the body of the disk-shaped breaker core (10). A plane of the netlike webbing (15) tensioned in the frame (12) is secured with a stepped offset to an upper end of the sidewall (17) facing the feeder, so that the netlike webbing (15) is placed in an area of an underside of the breaker core (10) facing the casting model.

15 Claims, 2 Drawing Sheets

BREAKER CORE WITH NETLIKE WEBBING SPANNING ITS THROUGH-OPENING

CROSS-REFERENCE TO RELATED APPLICATIONS

The instant application claims the priority date of Aug. 27, 2015, the filing date of the German patent application DE 20 2015 104 553.0.

BACKGROUND OF THE INVENTION

The present invention relates to a breaker core for use in a casting process, whereby the disk-shaped breaker core, which is provided with a through-opening for the liquid metal and has a netlike webbing spanning its through-opening, is fixable to the underside of a feeder body to be placed on the casting model and that faces the casting model.

In casting technology, it often is necessary to arrange an additional feeder in the casting mold, whose feeder body is filled with the liquid metal during casting of the casing piece and upon hardening of the casting piece, the feeder body compensate volume deficits that occur, in order to prevent the formation of cavitation shrink holes in the casting piece. In this connection, the feeder must be produced, such that the liquid metal that is fed into it hardens later than the casting piece, so that during the hardening process, a material transport to the casting piece can occur, which sealingly feeds the casting piece. In this regard, the feeders comprise an exothermic and/or insulating material or are formed as so-called natural feeders in the mold sand surrounding the casting model. In the frame of known methods for manufacturing casting molds that are provided with feeders, the feeders are arranged with any desired geometric form on the position to be supplied of the later casting piece on the casting model and with the formation of the casting mold by dealing of the mold sand that is applied, are solidly cast or molded. With another method, during casting of the casting model hollow spaces are produced by means of the mold sand, in which individual feeders made of an exothermic and/or insulating material are subsequently inserted and in this manner, are connected to the mold cavity produced by the demolding of the casting model in the casting mold. Thus, the feeders are arranged as so-called head feeders uniformly on the surface of the casting model or on the later=produced casting piece. A feeder with the above-noted characteristic features is described, for example, in DE 20 2013 104 863 U1.

A problem generally exists when using feeders. Specifically, after casting, hardened casting material in the form of so-called feeder residue remains in the feeder body, which must be removed after removing the casting piece from the feeder body. In order to facilitate this separation, the use of so-called breaker cores is common, which are defined on the feeder body on the underside of the feeder body facing toward the mold cavity of the casting mold. The breaker cores are made of a fire-resistant material and have a through-opening, via which the increasingly hot metal can flow out of the mold cavity of the casting mold into the inner cavity of the feeder body or from there flow further back into the mold cavity. The breaker cores, which are generally manufactured by shooting in a core shooting machine, are disk-shaped, whereby the through-opening is formed by a constriction formed in the disc-shaped breaker core body, in order to produce a predetermined breaking point for breaking off feeder residue from the surface of the casting piece.

Such an arrangement of the feeder with a breaker core is described, for example, in WO 2009/103539A1.

Breaker cores now have a netlike webbing which is anchored on the breaker core and which spans the through opening formed by the constriction. These netlike webbings permit the entry of the liquid metal in the cavity of the feeder body or from it back into the mold cavity, but also form a metal layer that is penetrated by the webbing, based on the bathing of the net structure by the hot metal after hardening of the casting piece, and thereby creates a defined material weakness, whereby the existing feeder residue can be knocked off in the course of the webbing layer. Thus, the netlike webbing, with the manufacture of the breaker core, is positioned in the plane of the constriction in the shooting mold and shot with the fire resistance molding material mixture that is used to make the breaker core.

With the arrangement of the netlike webbing in the interior of the breaker core, a spacing of the webbing from the surface of the casting piece is required, so that after breaking off of the feeder residue in the predetermined breaking points formed by the netlike webbing, a part of the feeder residue still remains on the casting part, which in turn, must be still be removed by expensive cleaning processes. Thus, the breaker core represents an additional and in particular, if including a netlike webbing, an expensive component that must be made.

SUMMARY OF THE INVENTION

The present invention is therefore based on the object of improving a breaker corer with the above-noted features, such that the occurrence of material residue remaining on the casting piece after the casting process and which must be removed by cleaning process is further reduced.

The present invention contemplates a breaker core with the above-noted features, in which, in the breaker core, a ring-shaped frame made of a heat-resistant material and having a netlike webbing tensioned over the frame is secured to the feeder body, the netlike webbing made of a fire-resistant material and spanning the through-opening of the breaker core, whereby the frame is secured to an outer sidewall on the body of the disk-shaped breaker core and the plane of the netlike webbing tensioned in the frame with a stepped offset to the upper end of the sidewall facing the feeder, so that the netlike webbing is positioned in the area of the underside of the breaker core that faces the casting model and is positioned with the feeder formed in the casting mold with the breaker core directly on the surface of the casting piece to be formed by the casting process.

An important advantage is connected with the present invention. Specifically, based on the design of the frame with the stepped offset of the plane provided on the lower end of the side wall for application of the netlike webbing to the opposite upper end of the frame, the plane of the netlike webbing is positioned approximately in the lower surface of the breaker core that contacts the casting model, so that the predetermined breaking point formed by the netlike webbing for the removal of the feeder residue is displaced directly onto the surface of the casting piece. Thus, any additional cleaning expenses are minimal. A further advantage is that, based on the netlike webbing tensioned in the frame, this frame can be manipulated as a special component with the manufacture of the breaker core in the shooting mold process in a process-safe manner. Regarding a sufficient tensioning of the netlike webbing in the flow path through the breaker core, it must be ensured that the webbing is not pulled into the mold cavity during the flow of liquid metal during the casting process. Thus, the arrangement of the frame enables a tensioning and holding of the netlike webbing in the frame, independently from the density of the mold mixture at the positioning points of the netlike webbing in the disk-shaped breaker core. The use of a frame made from a heat-resistant material for holding the tensioning netlike webbing offers the further advantage that the t the frame is not melted by the hot metal flowing through the breaker core and thus, no combustion gasses that are damaging to the casting process are present.

According to one embodiment of the invention, it is provided that on the upper end of the side wall, a radial, outwardly projecting, at least partially circumferential flange is formed and extends into the body of the disk-shaped breaker core. This offers the advantage that the frame that the frame with its flange engaged in the disk-shaped breaker core body is anchored securely in the body of the disk-shaped breaker core.

According to the present invention, an interior projection that assists and supports the netlike webbing is formed on the casting model. In this manner, the fixing of the netlike webbing is improved additionally during the through flow with the hot metal.

The sidewall, flange and/or projection therefore can have design that runs circumferentially on the frame; it is sufficient, however, if they are in the form of partial segments.

According to an embodiment of the present invention, the body of the breaker core covers the inside of the sidewall of the frame with a covered spandrel, whereby in the event an additional projection is provided, the spandrel also covers its upper side facing the feeder.

According to one embodiment of the invention, the ring-shaped frame comprises two frame parts that are moveable against one another, which after application of the required tensioning of the netlike web, are fastened together. It is preferable if the frame parts are formed with a congruent shape and are insertable into one another and the netlike webbing can be received between the two frame parts and the webbing tensioned by inserting the frame parts into one another. An appropriate connection technology for this can be so-called spot welding.

As a particular connecting technology for the frame parts for forming of the frame that tensions the netlike webbing, according to one embodiment, clinching according to the so-called TOX® method is proposed. Accordingly, it is provided that the frame parts are connected to one another, with the netlike webbing placed therebetween, via positive-fit and push or snap button connections produced as a result of a cold working process, whereby the punctiform connections of the frame parts, respectively, catch the netlike webbing placed between the frame parts. So that the netlike webbing placed between the frame parts before clinching is fixed by the so-called TOX® points, an improved and more stable clamping of the netlike webbing occurs in the frame in which the webbing is held, also with corresponding demands created by the metal flowing through the netlike webbing. In addition, by means of the various positions on the circumferential of the frame of the TOX® points, the tensioning of the netlike webbing in the frame is improved, and finally, the corresponding connecting technology is simple and cost-effective in serial production of the frame, because no heat treatment or application of additional connecting elements is required.

In addition, the frame parts that are insertable into one another each have a cup-shaped design with a slightly conical contour, that is, one which tapers from the upper end of the sidewall to its lower end with the netlike webbing fixed thereto.

According to one embodiment of the present invention, it can be provided that the frame with the netlike webbing tensioned therein is shot during manufacture of the breaker core by shooting into a shooting machine in the disk-shaped breaker core.

With regard to forming the netlike webbing, according to the present invention, the netlike webbing has a through-hole with a smaller dimension that the through-opening of the breaker core in order to reduce flow resistance. It can be provided further that the through-hole has a surface of 10% to 50% of the surface of the through-opening of the breaker core enclosed by the frame, whereby the net width, that is the width of the net opening, is 1 mm to 20 mm with a width of the fibers forming the net structure being 1 mm to 15 mm.

According to a further embodiment of the invention, the frame can be made from a heat-resistant material. Since, if necessary, the projection provided on the frame can come into contact with the liquid metal from the side of the casting model or mold cavity that is present before casting, because of the heat of the liquid metal, the casting part could be connected with the frame, which in turn, would make removal of the feeder residue more difficult. Thus, if a metal is used as the material for making the frame, the underside of the frame that faces the mold cavity is provided with a heat-resistant coating. In this connection, for example, a fire-resistant die coating can be used.

Alternatively, the frame can be made from ceramic or a fire-resistant material as the heat-resistant material.

BRIEF DESCRIPTION OF THE DRAWINGS

An exemplary embodiment of the present invention is shown in the drawings and will be described in greater detail below. In the figures.

DETAILED DESCRIPTION OF THE PREFERRED EMBODIMENTS

Figure 1:
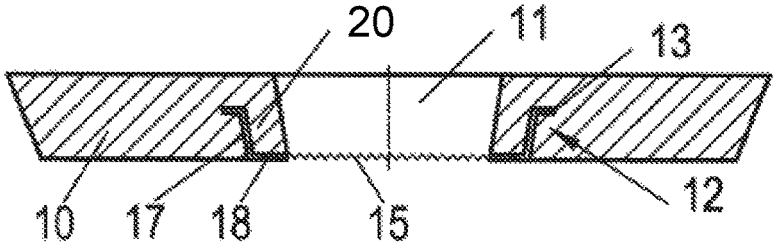
FIG. 1 shows a disk-shaped breaker core with a frame having a netlike webbing anchored and tensioned therein in cross section.

FIG. 1 shows a disc-shaped breaker core 10 with a centrally arranged through-opening 11, which is made from a fire-resistant molding mixture by shooting into a shooting machine. In the disc-shaped breaker core 10, a frame 12 is arranged, which holds a netlike webbing 15, which spans over the through-opening of the breaker core 10.

Figure 2:
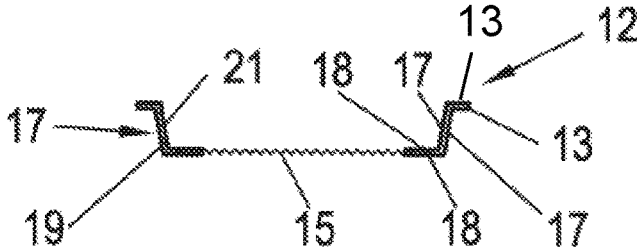
FIG. 2 shows the frame according to FIG. 1 in a detailed representation in cross section.

The frame 12 has a cup-shaped design with a circumferential sidewall 17, whereby the cup-shaped design tapers slightly conically to the netlike webbing 15. On the upper end of the sidewall 17, which has the greater diameter of the frame contour, an outer, circumferential, radially projecting flange 13 is formed, while the netlike webbing 15 is held on the lower end of the sidewall 17 that is oppositely disposed to the flange 13. As shown by combining FIGS. 2 and 3, the frame 12 comprises two frame parts having congruent shapes, namely, an outer frame part 19 and an inner frame part 20, which are inserted into one another. The netlike webbing 15 is arranged between the outer frame part 19 and the inner frame part 20 and is tensioned during the assembly of the frame 12 by the insertion of the two frame parts 19, 20 into one another; subsequently, the two frame parts 19, 20 are fixed to one another, preferably welded to one another. In this manner, a stabile component that can be manipulated safely when the breaker core is manufactured. With the embodiment shown, an inner, supporting projection 18 is formed on each of the two frame parts 19 and 20, respectively, on the end of the sidewall 17 opposite the flange 13, whereby both projections 18 commonly clamp the netlike webbing 15 between them and in this manner, offer additional support, in particular in the edge region. Both frame parts 19 and 20 are connected to each other by spot welding at points 22.

Figure 3:
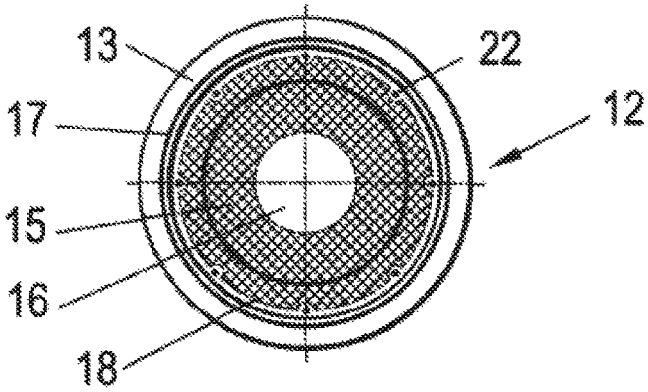
FIG. 3 shows the frame according to FIG. 2 including the netlike webbing tensioned therein in a plan view.

As shown in FIG. 3, it can be provided that in the netlike webbing, preferably centrally in the free surface ling within the frame, a through-hold 16 is provided, which serves to reduce the flow resistance with the breaker core. This through-hole 16 can have a surface of about 10 to 50% of the through-opening of the breaker core that is surrounded by the frame. Generally, this type of through-hole is not necessarily required.

The frame 12 is placed in the manufacture of the disk-shaped breaker core 10 in the shooting form, and thereby shot in the molding mixture such that the flange 13 will be positioned approximately in the center of the material thickness of the disk-shaped breaker core 10. Based on the offset of the netlike webbing 15 formed by the sidewall 1 of the frame 17 to the plane of the flange 13, the netlike webbing 15 is positioned in the breaker core 10, which is molded in the casting mold as a component of a feeder, so that the netlike webbing 15 is positioned directly on the surface of the casting piece to be formed during the casting process.

With the embodiment shown, the dimensions of the frame relative to the through-opening 11 of the breaker core 10 are selected, such that the material of the breaker core 10 also covers the inner side of the sidewall 17 with a spandrel 21, whereby the projection formed on the inner frame part 20 forms the bearing for the spandrel of the breaker core material covering the sidewall 17. In this regard, a particularly good anchoring of the frame 12 in the breaker core body can be realized; however, this is not necessarily required. The sidewall 17 also can form directly the inner wall of the through-opening, whereby then the flange 13 serves as a corresponding fixing of the frame 12 to the breaker core.

Figure 4:
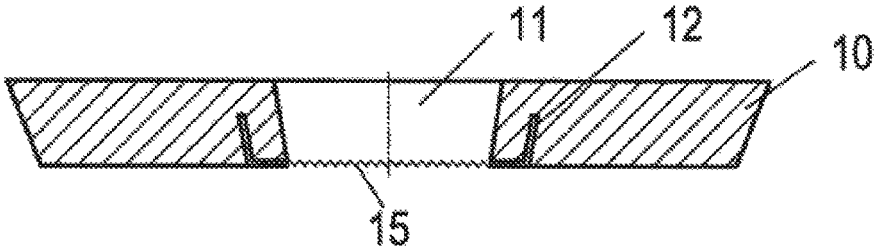
FIG. 4 shows a further embodiment of the breaker core according to FIG. 1.
Figure 5:
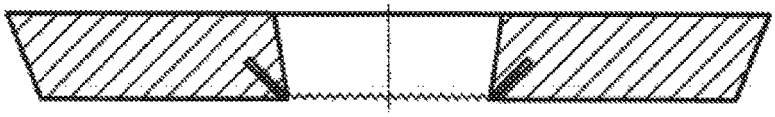
FIG. 5 shows a further embodiment of the breaker core according to FIG. 1.

The design of the frame 12 shown in the drawings with the flange 13 and the projection 18 represents an advantageous embodiment of the invention; however, also other forms of the frame 12 are included in the invention. Thus, the additional formation of the flange 13 on the frame 12 can be eliminated (FIG. 4), and it is also possible—alternatively or additionally—to eliminate the formation of the projection 18. In this case, the netlike webbing 15 is connected directly with the lower wall of the sidewall 17 (FIG. 5).

Figure 6:
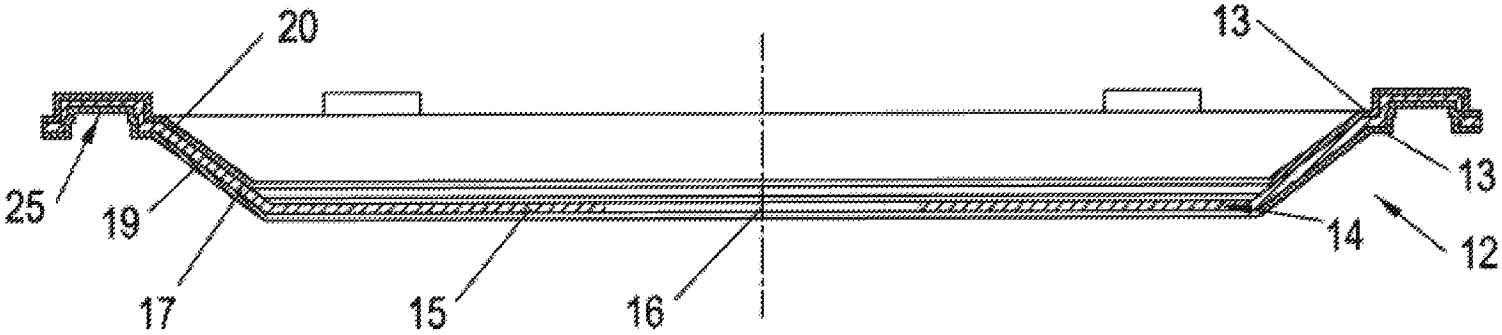
FIG. 6 shows a frame made from frame parts using clinching as a connecting technology.

FIG. 6 provides technically appropriate connecting techniques for connecting the frame parts 19, 20, which are especially suited for serial production of the frame in an easy to manipulate manner and in view of the specifications of the frame, including netlike webbing 15 held on the frame. It should be noted that a netlike webbing 15 having a through-hold 16 is placed between the frame parts 19, 20 and extends also in the region of the outer flanges 13 of the two frame parts 19, 20 that contact one another. In this region, both frame parts 19, 20 are connected to one another through the application of so-called TOX® points 25 in a clinching process. This known connecting technique requires no additional connecting means and does not require the use of heath, in that it uses a cold forming process to create a positive-fit and punctiform connection of the two flanges 13, whereby the TOX® points 25 are produced by introducing a matrix punch in a die by pressing in the materials lying between the matrix punch and the die into the die. Based on specialized die molds, a material hardening occurs in the die region, so that quasi press button type connections are created. By means of the punctiform pressing of the two flanges 13 including the netlike webbing 15 lying between them in the die used in the clinching process, the net tensioning is increased and is fixed accordingly after completion of the cold deformation.

The features of the subject matter of this invention set forth in the above description, the patent claims, the abstract and the drawings can be used individually and in any desired combination for the realization of the invention in its various embodiments.

The specification incorporates by reference the disclosure of DE 20 2015 104 553.0, filed Aug. 2, 2015.

The present invention is, of course, in no way restricted to the specific disclosure of the specification and drawings, but also encompasses any modifications within the scope of the appended claims.

We claim:

1. A breaker core for use in a casting process, comprising:

a disk-shaped breaker core (10) having breaker core body and a through-opening (11) for liquid metal;

a ring-shaped frame (12) secured to the breaker core (10), wherein said frame (12) is made from a heat-resistant material and has a netted webbing (15) tensioned therein, said netted webbing (15) made from a fire-proof material, wherein the netted webbing (15) spans the through-opening (11) of the breaker core (10) on an underside of a feeder to be placed on a casting model, the underside of the feeder facing the casting model, wherein the frame (17) is secured with an outer sidewall (17) to the body of the disk-shaped breaker core (10), wherein a plane of the netted webbing (15) tensioned in the frame (12) is secured with a stepped offset to an upper end of the sidewall (17) facing the feeder, so that the netted webbing (15) is placed in an area of an underside of the breaker core (10) facing the casting model and is positioned with the feeder formed in the casting mold with the breaker core (10) directly on an upper surface of a casting piece formed in the casting process.

2. The breaker core according to claim 1, wherein a radial, outwardly projecting, at least partially circumferential flange (13) is formed on the upper end of the sidewall (17) and extends into the body of the disk-shaped breaker core (10).

3. The breaker core according to claim 2, wherein the body of the breaker core (10) covers an inner side of the sidewall (17) of the frame (12) with a spandrel (21) covering the projection (18) on an upper side of said projection.

4. The breaker core according to claim 1, wherein a projection (18) that supports the netted webbing (15) is formed on a lower end of the sidewall (17) facing the casting model.

5. The breaker core according to claim 1, wherein the ring-shaped frame (12) comprises two frame parts (19, 20) that are moveable relative to one another, and wherein after tensioning of the netted webbing (15), the two frame parts (19, 20) are attachable to one another.

6. The breaker core according to claim 5, wherein the frame parts (19, 20) are insertable into one another to form the frame (12), wherein the netted webbing (15) is disposed between the two frame parts (19, 20) and is tensioned via attachment of the frame parts to one another.

7. The breaker core according to claim 6, wherein the frame parts (19, 20) with the netted webbing (15) disposed therebetween are connected to one another via clinching with positive-fit and push button connections made in a cold-forming process, wherein the connections of the frame parts (19, 20), respectively, catch the netted webbing (15) positioned between the two frame parts (19, 20).

8. The breaker core according to claim 6, wherein the frame parts (19, 20) that are insertable into one another each have a cup-shaped design with a conical contour, wherein the upper end of the sidewall (17) tapers to a lower end of the sidewall (17), wherein the netted webbing (15) is fixed to the lower end.

9. The breaker core according to claim 1, wherein the frame (12) with the netted webbing (15) tensioned therein is shot into the disc-shaped breaker core (10) during manufacture of the breaker core (10) by shooting into a shooting machine.

10. The breaker core according to claim 1, wherein the frame comprises a metal.

11. The breaker core according to claim 10, wherein a projection (18) is formed on a lower end of the sidewall (17) facing the casting model, wherein an underside of the projection (18) that faces the casting model is provided with a fire-resistant coating.

12. The breaker core according to claim 1, wherein the frame (12) comprises a ceramic or a fire-resistant material.

13. The breaker core according to claim 1, wherein the netted netlike webbing (15) has a through-hole (16), wherein said though-hole (16) is dimensioned to be smaller than the through-opening (11).

14. The breaker core according to claim 13, wherein the through-hole 16 has a surface of 10% to 50% of a surface of the netted webbing (15) enclosed by the frame (12).

15. The breaker core according to claim 1, wherein a width of a net opening in the netted webbing (5) is 1 mm to 2 mm, wherein a net structure of the netted webbing comprises a plurality of fibers, wherein each of said fibers has a width of 1 mm to 15 mm.

* * * * *